United States Patent [19]

Hildebrand

[11] Patent Number: 4,824,524

[45] Date of Patent: Apr. 25, 1989

[54] MULTI-PLY HEADBOX FOR A PAPERMAKING MACHINE

[75] Inventor: Otto Hildebrand, Ravensburg-Taldorf, Fed. Rep. of Germany

[73] Assignee: Sulzer Escher Wyss GmbH, Ravensburg, Fed. Rep. of Germany

[21] Appl. No.: 149,658

[22] Filed: Jan. 28, 1988

[30] Foreign Application Priority Data

Feb. 2, 1987 [CH] Switzerland ..... 00 358/87

[51] Int. Cl.[4] ..... D21F 1/02; D21F 1/06

[52] U.S. Cl. ..... 162/343; 162/336; 162/344; 162/347

[58] Field of Search ..... 162/336, 343, 344, 347, 162/123

[56] References Cited

U.S. PATENT DOCUMENTS

| | | | |
|---|---|---|---|
| 3,598,696 | 10/1971 | Beck | 162/343 |
| 3,645,843 | 2/1972 | Schmaeng | 162/347 |
| 4,070,238 | 1/1978 | Wahren . | |
| 4,181,568 | 1/1980 | Pfaler | 162/343 |
| 4,358,342 | 11/1982 | Nuttall | 162/347 |
| 4,372,816 | 2/1983 | Wolf et al. | 161/336 |
| 4,543,162 | 9/1985 | Hildebrand | 162/343 |

FOREIGN PATENT DOCUMENTS

| | | | |
|---|---|---|---|
| 377026 | 6/1984 | Austria . | |
| 3107926 | 11/1982 | Fed. Rep. of Germany . | |
| 2824608 | 8/1986 | Fed. Rep. of Germany . | |
| 8102903 | 10/1981 | PCT Int'l Appl. . | |
| 1457667 | 12/1976 | United Kingdom . | |
| 2019465 | 10/1979 | United Kingdom | 162/343 |
| 2094364 | 3/1981 | United Kingdom | 162/123 |

*Primary Examiner*—Karen Hastings

*Attorney, Agent, or Firm*—Werner W. Kleeman

[57] ABSTRACT

In a multi-ply headbox, the nozzle chamber is subdivided by rigid partition walls into a number of nozzle chambers, and the slice openings or outlet slices are adjustable independently of one another. This is accomplished by providing a pivotable mounting of the partition wall or walls in a guide block, for instance, such pivotable mounting being accomplished by a substantially cylindrical shell or cup bearing structure. The desired pivotable movement or adjustment of the rigid partition wall can be undertaken by an inclined groove-cam guide arrangement effective at a projection of the partition wall or by pressure cushions, such as pressure hoses effective at both sides of the projection.

8 Claims, 2 Drawing Sheets

MULTI-PLY HEADBOX FOR A PAPERMAKING MACHINE

BACKGROUND OF THE INVENTION

The present invention broadly relates to the papermaking art, and, in particular, is directed to a new and improved construction of a headbox for a papermaking machine.

Generally speaking, the headbox of the present development for a papermaking machine is of the type comprising a guide block possessing at least one guide channel through which flows the fiber stock suspension. A nozzle chamber merges with the guide block and is bounded by two lips or lip members which form a slice opening or outlet slice for the efflux of the fiber stock suspension. The nozzle chamber is subdivided into at least two nozzle chambers or sub-passageways by at least one adjustable partition or divider wall.

Such type of headbox is disclosed, for instance, in the German Patent No. 3,227,218 or the U.S. Pat. No. 4,543,162, granted Sept. 24, 1985. This headbox serves for the fabrication of a multi-ply paper web by mutually independently charging or infeeding the individual nozzle chambers with fiber stock suspensions. The partition walls between the individual nozzle chambers are designed to be displaceable in the direction of flow of the fiber stock suspensions in order to be able to regulate or adjust different velocities and pressures of the fiber stock suspension in the individual nozzle chambers. As a result, it is possible to regulate and adjust to a certain degree, the properties of the individual plys of the produced paper web but the adjustment possibilities are not totally adequate for certain multi-ply types of paper.

It is also already known to construct the partition walls in the nozzle chamber to be flexible, so that they automatically adjust themselves in a manner such that in all of the nozzle chambers, there prevails the same pressure. With this headbox design, it is not possible to adjust the flow of the fiber stock suspension in the individual nozzle chambers and it is also not possible to adjust independently of one another, the outlet slices or slice openings of the individual paper plys.

SUMMARY OF THE INVENTION

Therefore, with the foregoing in mind, it is a primary object of the present invention to provide a new and improved construction of a headbox for a papermaking machine which is not afflicted with the aforementioned drawbacks and limitations of the prior art.

Another and more specific object of the present invention aims at the provision of a new and improved construction of a headbox of the previously mentioned type which allows independently charging or infeeding the individual nozzle chambers or sub-passageways with fiber stock suspensions at velocities and pressures which are mutually independent of one another as well as rendering possible an adjustment of the slice openings or outlet slices of the individual nozzle chambers independently of one another.

A further significant object of the present invention aims at providing a new and improved construction of a multi-ply headbox having a plurality of nozzle chambers and a plurality of slice openings or outlet slices, wherein the nozzle chambers can be individually supplied with fiber stock suspension mutually independent on one another and the flow velocities and pressures of the fiber stock suspensions prevailing in the individual nozzle chambers can be regulated independently of one another and there also can be adjusted, the slice openings or outlet slices of the nozzle chambers independently of one another.

Yet a further significant object of the present invention is directed to an improved construction of a multi-ply headbox which is relatively simple in design, quite economical to manufacture, extremely reliable in operation, not readily subject to breakdown or malfunction and requires a minimum of maintenance and servicing.

Still a further notable object of the present invention is directed to a multi-ply headbox having at least one rigid partition wall for forming within the headbox, a plurality of nozzle chambers, wherein the rigid partition wall is provided with means which allow for relatively easy and accurate adjustment of the position thereof within the headbox so that there can be regulated the velocity and pressure of each of the fiber stock suspensions flowing through the individual nozzle chambers independently of one another.

Now in order to implement these and still further objects of the invention, which will become more readily apparent as the description proceeds, the headbox of the present development is manifested by the features that there is provided at least one rigid partition wall which is mounted at the guide block by a pivotable mounting means, such that the pivot axis of the rigid partition wall extends transverse to the direction of flow of the fiber stock suspension.

Advantageously, the mounting or bearing structure for the rigid partition wall is constructed as a substantially cylindrical shell or cup bearing or mounting arrangement, and an adjustment device operatively engages with a rearwardly directed projection or protrusion of the rigid partition wall within the guide block.

The adjustment or adjusting device also can be beneficially constructed as a mechanically actuated inclined groove-cam guide arrangement, in other words, a cam guide arrangement provided with an inclined groove for selectively positioning the at least one rigid partition wall, or the adjustment can be accomplished by controlling the pressure in pressure cushions, such as pressure hoses, acting upon the rearwardly directed projection of the at least one rigid partition wall.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
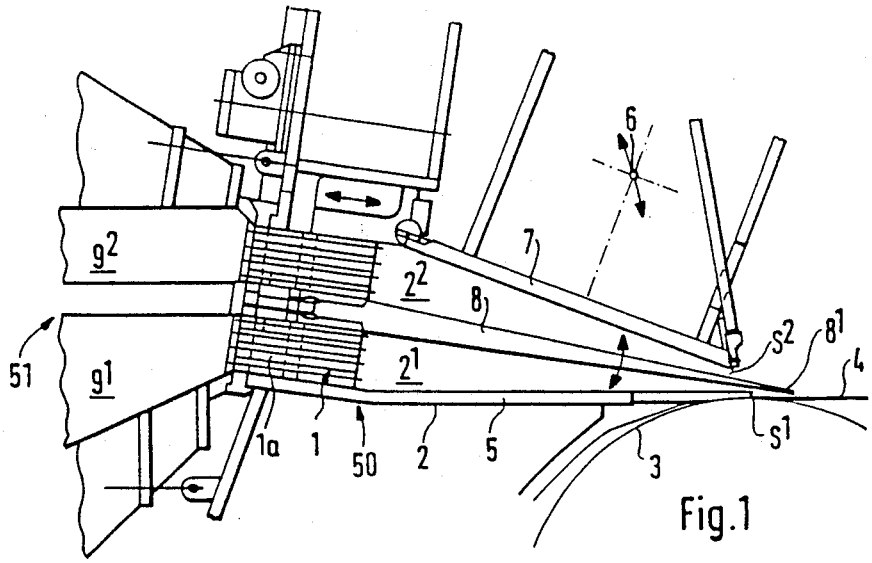
FIG. 1 is a cross-sectional view through a first exemplary embodiment of a headbox constructed according to the present invention.

Describing now the drawings, it is to be understood that to simplify the showing thereof, only enough of the construction of the headbox and related papermaking machine has been illustrated therein as is needed to enable one skilled in the art to readily understand the underlying principles and concepts of the present invention. Turning now specifically to FIG. 1 of the drawings, there is depicted therein in sectional view, a first exemplary embodiment of headbox 50 which especially is useful as a multi-ply headbox for a longitudinal wire papermaking machine. This longitudinal wire papermaking machine may be of conventional design and therefore need not be here further considered, particularly since the details thereof are unimportant for comprehending the principles and concepts of the present invention as concerns the headbox structure. This headbox 50 comprises a guide block or element 1 or equivalent structure having substantially parallel channels or ducts 1a through which there can flow the fiber stock suspension and which can be constructed, for instance, as a stepped diffusor in the manner taught in U.S. Pat. No. 3,725,197, or in any other suitable fashion.

Merging with the guide block 1 is a main nozzle chamber or passageway 2 defining an internal compartment of the headbox 50 and which is bounded or delimited towards the outside by a rigid lip member or lip 5 at one side thereof and at the opposite side by a rigid lip or lip member 7 which is, however, independently adjustable in conventional fashion by a suitable adjustment mechanism or device 6. In the exemplary embodiment under discussion, this main nozzle chamber or passageway 2 is subdivided into two nozzle chambers or sub-passageways $2^1$ and $2^2$ by a pivotably mounted rigid partition or divider wall or wall member 8, for instance, formed of metal or another sufficiently rigid or stiff material, so that between the partition wall 8 and the lip members 2 and 7, there is formed a respective outlet slice or slice opening $S^1$ and $S^2$ for the fiber stock suspensions flowing through the nozzle chambers $2^1$ and $2^2$, respectively. When infeeding or delivering different fiber stock suspensions from separate distributor chambers $9^1$ and $9^2$ of a distributor box or distributor, generally indicated by reference character 51, through the channels 1a of the guide block 1, there is formed upon the wire or sieve 4 or the like trained about the roller 3, different plys of paper stock, as is well known in this technology. Externally of the outlet slices or slice openings $S^1$ and $S^2$ there can be arranged at the rigid partition wall or wall member 8, a flexible foil or sheet $8^1$.

Figure 3:
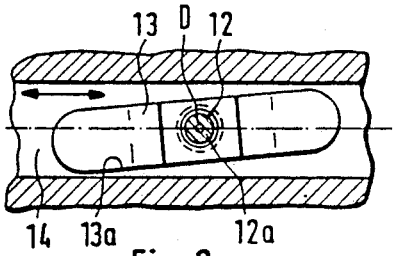
FIG. 3 is a cross-sectional view of the detail showing of FIG. 2, taken substantially along the section line A—A thereof.
Figure 2:
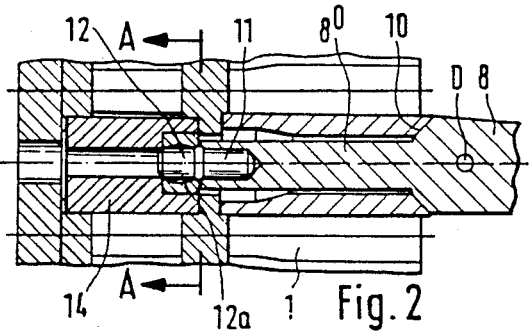
FIG. 2 is an enlarged detail showing of part of the headbox arrangement of FIG. 1.

With reference now to FIG. 2, there is depicted therein on an enlarged scale, the bearing or mounting arrangement for pivotably mounting the rigid partition wall or wall member 8 at the guide block 1. The bearing or mounting arrangement comprises, in the embodiment depicted, a substantially cylindrical shell or cup bearing structure 10 providing a pivot axis D for the rigid partition wall 8 and which pivot axis D extends transverse to the flow direction of the fiber stock suspensions flowing through the nozzle chambers $2^1$ and $2^2$. At a rearwardly positioned or rearward projection or protrusion $8^0$ of the rigid partition wall 8, i.e a projection or protrusion $8^0$ extending from the pivot axis D, there is provided a pin or pin member 11 which engages by means of, for instance, a spherical socket **12*a* or the like into a slide or glide block or element 12 of an inclined groove-cam guide 13, further details of which have been illustrated in the sectional view of FIG. 3 which constitutes a section taken substantially along the line A—A of FIG. 2. Stated in another way, the slide or glide block or block member 12 which is attached or operatively connected to the pin or pin member 11 or the like mounted at the rearward extending projection $8^0$ of the rigid partition wall 8, coacts with an inclined groove 13*a* of the cam guide or guide member 13 so that by selectively transversely shifting the cam guide 13 in the one or other direction of the double-headed arrow depicted in FIG. 3, the rigid partition wall 8 can be selectively and accurately positioned within the main nozzle chamber 2 of the headbox 50 in order to alter, as desired, the velocities and pressures prevailing in the nozzle chambers or sub-passageways $2^1$ and $2^2$. As can be seen in FIG. 2, projection $8^0$ extends rearwardly from the pivot axis D as viewed in the predeterminate direction of flow of fiber suspension and is connected for conjoint movement with the rigid partition wall 8**.

By means of an adjustment rod member or rod 14 or equivalent actuator structure which is guided in the guide block or block member 1 for movement in a direction transverse to the flow direction of the fiber stock suspensions, the slide block or block member 12 can be selectively displaced within the cam guide 13 and thus the projection $8^0$ and the rigid partition wall 8 can be pivoted or rocked through a predeterminate angle about the transversely extending pivot axis D. In conjunction with the setting of the pivotable lip or lip member 7 and by controllably pivoting the rigidly constructed partition wall 8, both of the outlet slices or slice openings $S^1$ and $S^2$ for the fiber stock suspensions effluxing out of the nozzle chambers $2^1$ and $2^2$ can be independently adjusted with respect to one another, and thus there also can be regulated the properties of the two paper stock plys or layers which are deposited upon the wire or sieve 4 or equivalent paper web forming structure.

Figure 4:
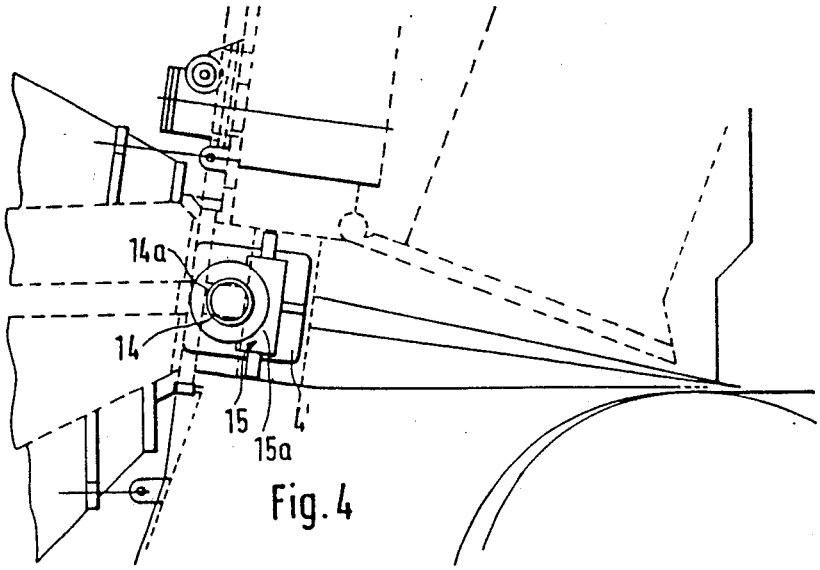
FIG. 4 is a front view of a side portion of the headbox of the arrangement of FIG. 1.

FIG. 4 shows in side elevational view the adjustment or adjusting device, here in the form of adjustment gearing or gear means 15 arranged at the lateral end or side of the guide block 4' for selectively displacing the adjustment rod or rod member 14 of the inclined groove-cam guide 13 and composed of a worm gearing **15*a* engaging at a threaded rod or rod member 14*a***. Instead of such type of adjustment device or mechanism, there also could be provided any other suitable adjustment devices or mechanisms, especially those which can be controlled by means of a regulation or control circuit based upon measured properties or characteristics of the flow of the fiber stock suspensions or the paper plys.

Figure 5:
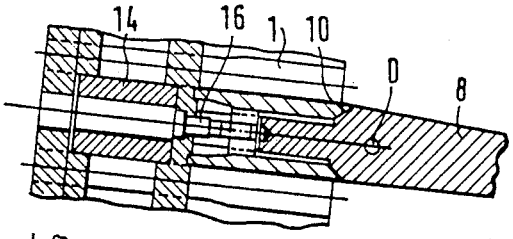
FIG. 5 is an enlarged detail showing of the headbox of the arrangement of FIG. 1.

In FIG. 5 there is depicted the mounting of the rigid partition wall or wall member 8 at the guide block 1 by means of threaded bolts or screws 16 or equivalent fastening expedients.

At this juncture, it is remarked that instead of using a single rigid partition wall 8, as such has been disclosed by way of example in the previously described embodiment, it would also be possible to provide a number of rigid partition walls or wall members in the main nozzle chamber 2 by means of which this main nozzle chamber 2 can be subdivided into three or more superimposed nozzle chambers or sub-passageways, so that it is thereby possible to produce a multi-ply paper web composed of three or more plys which is then deposited upon the forming wire or sieve 4 or the like.

Figure 6:
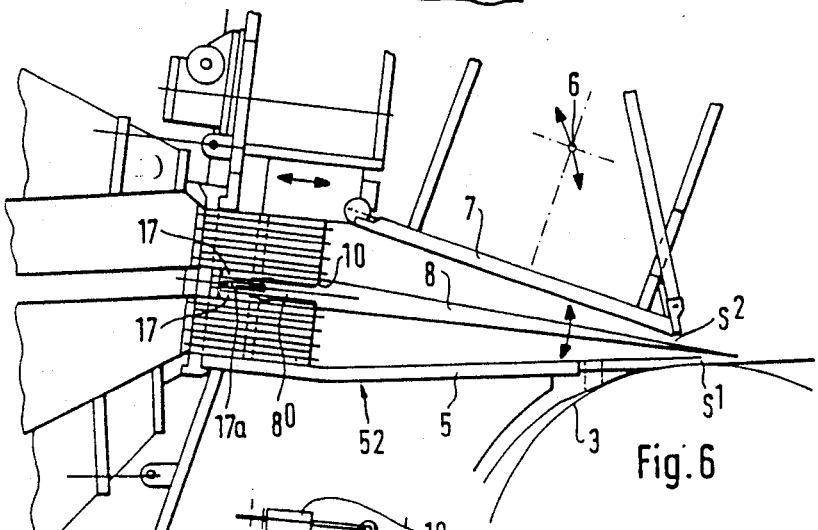
FIG. 6 is a cross-sectional view through a further embodiment of a headbox constructed according to the present invention.

FIG. 6 illustrates a further exemplary embodiment of a headbox 52 wherein the pivoting of the rigid partition wall 8 about the pivot axis D of the cylinder shell or cup bearing or mounting arrangement 10 is accomplished by means of two pressurized cushions 17 acting at both sides of the rearward projection $8^0$ of the rigid partition wall 8. These pressurized or pressure cushions or cushion members 17 can be constituted by pressure hoses or hose members 17a extending transverse to the flow direction of the fiber stock suspensions over the width of the headbox 52 and which can be filled with any suitable pressurized fluid medium at an adjustable pressure.

Figure 7:
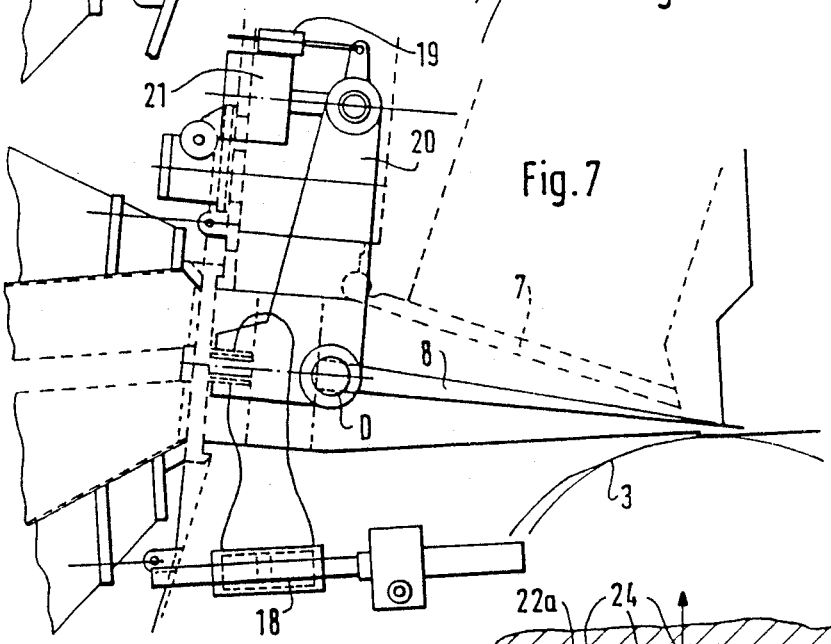
FIG. 7 is a side view of the side portion of the modified construction of the headbox depicted in FIG. 6.

As depicted in FIG. 7, such pressure cushions 17 can be alternately impinged with the pressurized fluid medium, depending upon the desired direction of pivotable motion of the pivotable rigid partition wall 8, by means of a finely-controlled differential cylinder unit 18 or any other equivalent structure for selectively pressurizing the pressure cushions 17.

As a result, there can be accomplished a uniform adjustment of the rigid partition wall 8 over the entire width of the headbox 52. The control of the pressure and thus the pivotable movement of the rigid partition wall 8 is here accomplished by a suitable measuring device 19. To ensure that the positional adjustment of the rigid partition wall 8 remains constant during operation of the headbox 52, the adjustment can be locked or fixed by means of a lever member 20 or equivalent structure, for instance, through the action of suitable hydraulic or electromagnetic brake devices or means 21.

The mounting of the partition wall or wall member 8 at the substantially cylindrical shell or cup bearing structure 10 is accomplished in the manner depicted in FIGS. 6 and 7 wherein, on the one hand, such is achieved by the hydraulic axial forces of the pressure cushions 17 and, on the other hand, by the lever member 20 which is mounted at the pivot axis D.

It should be understood that instead of the described mechanical and hydraulic adjustment devices, by means of which there can be achieved the desired controlled pivotable motion or pivotability of the rigid partition wall or walls 8, there can be utilized other types of pivot mechanisms or devices for pivoting the rigid partition wall or walls with analogous advantages, for instance, there can be employed electromagnetic or pneumatically operating adjustment devices.

Figure 8:
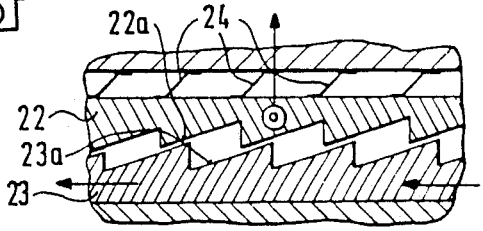
FIG. 8 is a fragmentary sectional view of a further modification of an adjustment or adjusting device or mechanism for the rigid partition wall and which can be used in the different embodiments of headboxes of the invention.

FIG. 8 shows by way of example, a further embodiment of a mechanical adjustment mechanism or device for selectively adjusting the position of the associated rigid partition wall 8 and employing two mutually displaceable and coacting tooth or toothed racks or rack member 22 and 23. The upper tooth or toothed rack 22 is, for instance, connected with the attachment pin or pin member 11 of the rearward projection or protrusion $8^0$ of the related rigid partition walls 8 and can be moved, as will be explained shortly, in vertical direction of the showing of FIG. 8. On the other hand, the lower tooth or toothed rack or rack member 23 is displaceable in horizontal direction in the illustration of FIG. 8. By means of suitable resilient elements 24, such as springs, both of the tooth or toothed racks 22 and 23 can be pressed against one another. Upon selectively laterally displacing the lower toothed rack 23 and by virtue of the coacting saw teeth 22a and 23a of the upper and lower tooth or toothed racks 22 and 23, respectively, the upper toothed rack 22 together with the rigid partition wall 8 secured thereat can be appropriately and controllably vertically moved in the showing of FIG. 8 and thus positionally adjusted within the main nozzle chamber 2 of the related headbox.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A headbox for a papermaking machine, comprising:

means defining an internal compartment within the headbox;

guide block means arranged in said headbox and flow communicating with said internal compartment;

said guide block means containing guide channels through which there can flow at least one fiber stock suspension in a predeterminate direction of flow;

said means defining said internal compartment comprising two lip members;

at least one adjustable rigid partition wall arranged in said internal compartment for dividing said internal compartment into at least two nozzle chambers;

said at least one rigid partition wall coacting with said two lip members to define at least two outlet slices for the fiber stock suspension;

means for pivotably mounting the at least one rigid partition wall at the guide block so as to have a pivot axis extending transverse with respect to the predeterminate direction of flow of the fiber stock suspension;

said pivotable mounting means comprising substantially cylindrical shell bearing structure for mounting said at least one rigid partition wall for pivotable movement about said pivot axis extending transverse to the direction of flow of the fiber stock suspension;

said at least one rigid partition wall being provided with a projection extending from said pivot axis;

said projection extending rearwardly from said pivot axis as viewed in said predeterminate direction of flow of the fiber stock suspension and connected for conjoint movement with the pivotably mounted at least one rigid partition wall;

adjustment means for selectively adjusting the position of said at least one rigid partition wall; and said adjustment means operatively engaging said projection of said at least one rigid partition wall for accomplishing a selective pivoting of the at least one rigid partition wall about the pivot axis extending transverse to the predeterminate direction of flow of the fiber stock suspension.

2. The headbox as defined in claim 1, wherein:

said adjustment means comprising at least one pressure cushion pressing upon the projection extending from the pivot axis of the at least one rigid partition wall and serving for pivoting the projection and thereby the at least one rigid partition wall.

3. The headbox as defined in claim 1, further including:

means for pivotably mounting at least one of said lip members; and means for pivoting said at least one pivotably mounted lip member independent of pivotal movement of the rigid partition wall.

4. A headbox for a papermaking machine, comprising:

means defining an internal compartment within the headbox;

guide block means arranged in said headbox and flow communicating with said internal compartment;

said guide block means containing guide channels through which there can flow at least one fiber stock suspension in a predeterminate direction of flow;

said means defining said internal compartment comprising two lip members;

at least one adjustable rigid partition wall arranged in said internal compartment for dividing said internal compartment into at least two nozzle chambers;

said at least one rigid partition wall coacting with said two lip members to define at least two outlet slices for the fiber stock suspension;

means for pivotably mounting the at least one rigid partition wall at the guide block so as to have a pivot axis extending transverse with respect to the predeterminate direction of flow of the fiber stock suspension;

said pivotable mounting means comprising substantially cylindrical shell bearing structure for mounting said at least one rigid partition wall for pivotable movement about said pivot axis extending transverse to the direction of flow of the fiber stock suspension;

said at least one rigid partition wall being provided with a projection extending from said pivot axis as viewed in said predeterminate direction of flow of the fiber stock suspension;

adjustment means for selectively adjusting the position of said at least one rigid partition wall and operatively engaging with said projection of said at least one rigid partition wall for accomplishing a selective pivoting of the at least one rigid partition wall about the pivot axis extending transverse to the predeterminate direction of flow of the fiber stock suspension;

said adjustment means comprising an inclined groove-cam guide arrangement;

said inclined groove-cam guide arrangement comprising a slide element coacting with said projection of said at least one rigid partition wall;

said inclined groove-cam guide arrangement including an inclined groove; and said slide element slidably coacting with said inclined groove for selectively positioning the at least one rigid partition wall.

5. The headbox as defined in claim 4, wherein:

said adjustment means further comprises a rod member moveably mounted at said slide element for movement transverse to the predeterminate direction of flow of the fiber stock suspension; and said rod member displacing said slide element in said inclined groove.

6. The headbox as defined in claim 4, wherein:

said slide element comprises a slide block slidably arranged in said inclined groove.

7. A headbox for a papermaking machine, comprising:

means defining an internal compartment within the headbox;

guide block means arranged in said headbox and flow communicating with said internal compartment;

said guide block means containing guide channels through which there can flow at least one fiber stock suspension in a predeterminate direction of flow;

said means defining said internal compartment comprising two lip members;

at least one adjustable rigid partition wall arranged in said internal compartment for dividing said internal compartment into at least two nozzle chambers;

said at least one rigid partition wall coacting with said two lip members to define at least two outlet slices for the fiber stock suspension;

means for pivotably mounting the at least one rigid partition wall at the guide block so as to have a pivot axis extending transverse with respect to the predeterminate direction of flow of the fiber stock suspension;

said at least one rigid partition wall being provided with a projection extending from said pivot axis as viewed in said predeterminate direction of flow of the fiber stock suspension;

adjustment means for selectively adjusting the position of said at least one rigid partition wall and operatively engaging with said projection of said at least one rigid partition wall for accomplishing a selective pivoting of the at least one rigid partition wall about the pivot axis extending transverse to the predeterminate direction of flow of the fiber stock suspension;

said adjustment means comprising at least two pressure cushions pressing upon the projection of the at least one rigid partition wall and serving for pivoting the at least one rigid partition wall;

a respective one of said at least two pressure cushions being arranged at each side of opposite sides of the projection of the at least one rigid partition wall; and said pressure cushions governing the pivotable movement of the at least one rigid partition wall by a pressure difference prevailing in said oppositely situated pressure cushions arranged at opposite sides of the projection of the at least one rigid partition wall.

8. A headbox for a papermaking machine, comprising:

means defining an internal compartment within the headbox;

guide block means arranged in said headbox and flow communicating with said internal compartment;

said guide block means containing guide channels through which there can flow at least one fiber stock suspension in a predeterminate direction of flow;

said means defining said internal compartment comprising two lip members;

at least one adjustable rigid partition wall arranged in said internal compartment for dividing said internal compartment into at least two nozzle chambers;

said at least one rigid partition wall coacting with said two lip members to define at least two outlet slices for the fiber stock suspension;

means for pivotably mounting the at least one rigid partition wall at the guide block so as to have a pivot axis extending transverse with respect to the predeterminate direction of flow of the fiber stock suspension;

said at least one rigid partition wall being provided with a projection extending rearwardly from said pivot axis as viewed in said predeterminate direction of flow of the fiber stock suspension;

adjustment means for selectively adjusting the position of said at least one rigid partition wall and operatively engaging with said projection of said at least one rigid partition wall for accomplishing a selective pivoting of the at least one rigid partition wall about the pivot axis extending transverse to the predeterminate direction of flow of the fiber stock suspension;

said adjustment means comprising two mutually displaceable, coacting toothed rack means cooperating with said at least one rigid partition wall for selectively positioning said at least one rigid partition wall; and one of said two mutually displaceable, coacting toothed rack means being fixedly connected to said projection extending rearwardly from said pivot axis.

* * * * *